United States Patent [19]

Fleck et al.

[11] 4,423,946

[45] Jan. 3, 1984

[54] LOCKING ARRANGEMENT FOR GUIDES IN PHOTOGRAPHIC MATERIAL DEVELOPER APPARATUS

[75] Inventors: Adolf Fleck, Unterhaching; Hans Ketterer, Munich; Gerald Pietsch, Kaufbeuren, all of Fed. Rep. of Germany

[73] Assignee: Agfa-Gevaert Aktiengesellschaft, Leverkusen, Fed. Rep. of Germany

[21] Appl. No.: 418,089

[22] Filed: Sep. 14, 1982

[30] Foreign Application Priority Data

Dec. 11, 1981 [DE] Fed. Rep. of Germany ..... 3149111

[51] Int. Cl.[3] ..... G03D 3/08

[52] U.S. Cl. ..... 354/319; 354/338; 226/196

[58] Field of Search ..... 354/319, 320, 321, 322, 354/338, 339; 226/196, 197, 198, 199; 118/428

[56] References Cited

U.S. PATENT DOCUMENTS

| | | | |
|---|---|---|---|
| 2,989,914 | 6/1961 | Reick | 354/338 |
| 3,359,945 | 12/1967 | Hastings et al. | 354/339 |
| 3,608,467 | 9/1971 | Rouff | 226/196 |
| 3,956,764 | 5/1976 | Schausberger | 354/339 |

*Primary Examiner*—A. A. Mathews

*Attorney, Agent, or Firm*—Kontler, Grimes & Battersby

[57] ABSTRACT

A conveying arrangement in a developing apparatus for photographic material has pairs of conveying rollers as well as guiding and/or deflecting sheets which extend between two opposite sidewalls. Fastening elements are provided on both sidewalls and are adapted to hold the ends of a guiding and/or deflecting sheet against movement in all directions except for an unlocking direction. A removable, deformable locking element is further provided and is adapted to prevent movement of the sheets in the unlocking direction. The fastening element for a guiding and/or deflecting sheet includes a cutout in each of the sidewalls and a positioning pin in at least one of the cutouts. The positioning pin cooperates with an opening in the corresponding guiding and/or deflecting sheet.

6 Claims, 3 Drawing Figures

LOCKING ARRANGEMENT FOR GUIDES IN PHOTOGRAPHIC MATERIAL DEVELOPER APPARATUS

BACKGROUND OF THE INVENTION

The present invention relates generally to a conveying arrangement in photographic material developer apparatus and, more particularly, to such a conveying arrangement in developer apparatus of the type having a pair of conveying rollers and a corresponding pair of guiding and/or deflecting sheets which extend between the sidewalls of the apparatus for guiding the photographic material within the apparatus for processing therein.

In such conveying arrangements, it is well known to provide means for guiding or deflecting the photographic material between the pair of rollers in order to properly position the material during conveyance thereof. The roller pairs in such prior art arrangements are typically supported by the two sidewalls of the apparatus while the guiding or deflecting means are normally secured to the sidewalls by the use of screw connections. It will of course be appreciated that by so mounting the guiding and deflecting means, it requires a relatively long period of time to effect mounting as well as to remove or otherwise exchange the guiding or deflecting means for repair or for cleaning. In both circumstances, much time is lost.

OBJECTS AND SUMMARY OF THE INVENTION

It is an object of the present invention to provide a conveying arrangement in a photographic material developer apparatus in which the guiding and deflecting means may be readily installed and removed.

It is another object of the present invention to provide such an arrangement wherein the guiding and deflecting sheets are fixedly maintained in position during use by removable locking elements.

It is yet another object of the present invention to provide such an arrangement wherein the locking elements are deformable.

Against the foregoing background and objects, the present invention, in brief summary, comprises a conveying arrangement in photographic material developer apparatus wherein the conveying arrangement includes a pair of conveying rollers and a pair of guiding and/or deflecting sheets which extend between the sidewalls of said apparatus. The conveying arrangement includes fastening elements at both sidewalls which prevent movement of the ends of a guiding and/or deflecting sheet in all directions other than the locking direction. The conveying arrangement further includes a removable, deformable locking element which prevents movements of the ends of the guiding and/or deflecting sheet in an unlocking direction.

It will of course be appreciated that the aforementioned conveying arrangement achieves substantial savings in time and labor during installation and removal of the guiding or deflecting means. Moreover, such an arrangement eliminates the necessity for the use of tools in effecting installation and/or removal. Further, manufacture of the guiding and/or deflecting sheets and of the sidewalls is simplified in that it no longer becomes necessary to provide exact and/or precision dimensions. Still further, expensive, acid resisting fastening elements may be replaced by a simple locking element of conventional deformable material, such as, for example, rubber or synthetic resins.

The novel features which are considered as characteristic of the invention are set forth in particular in the appended claims. The conveying arrangement of the subject application together with additional features and advantages thereof will, however, be best understood upon perusal of the following detailed description of certain specific embodiments of the novel arrangement of the subject application.

BRIEF DESCRIPTION OF THE DRAWINGS

FIG. 2 is a perpsective view of a guiding sheet in accordance with the present invention illustrated in an unlocked condition; and .

DESCRIPTION OF THE PREFERRED EMBODIMENTS

Figure 1:
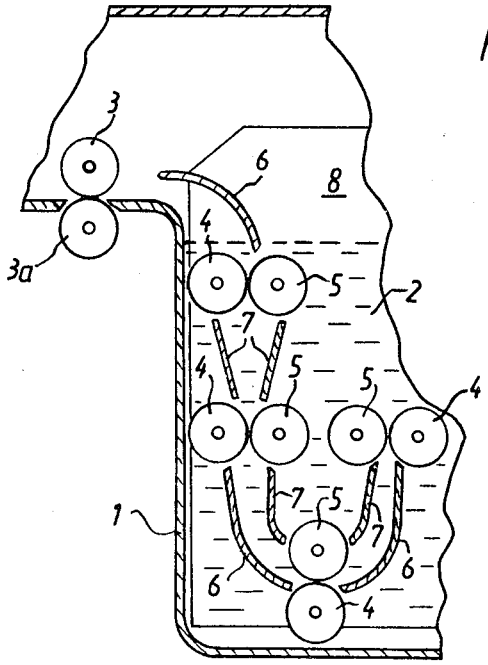
FIG. 1 is a cross sectional view of a portion of a photographic developing apparatus.

Referring first to FIG. 1, a photographic developer apparatus having a vessel identified by reference numeral 1 is illustrated in cross section. The vessel 1 includes a processing bath 2 of suitable developer chemicals; a pair of entry rollers 3, 3*a* to permit introduction of photographic material into the vessel and a plurality of conveying rollers 4, 5 arranged in said apparatus to convey or otherwise advance said photographic material through the processing bath 2. At least one pair of a deflecting sheet 6 and a guiding sheet 7 are provided between each pair of conveying rollers 4, 5 to assist in conveyance of the photographic material. The pairs of conveying rollers 4, 5 as well as deflecting sheets 6 and guiding sheets 7 are supported by the opposite sidewalls 8 of vessel 1, one of said sidewalls being illustrated in FIG. 1. The mounting of deflecting sheets 6 and guiding sheets 7 to the sidewalls 8 is illustrated in greater detail in FIGS. 2 and 3.

Figure 2:
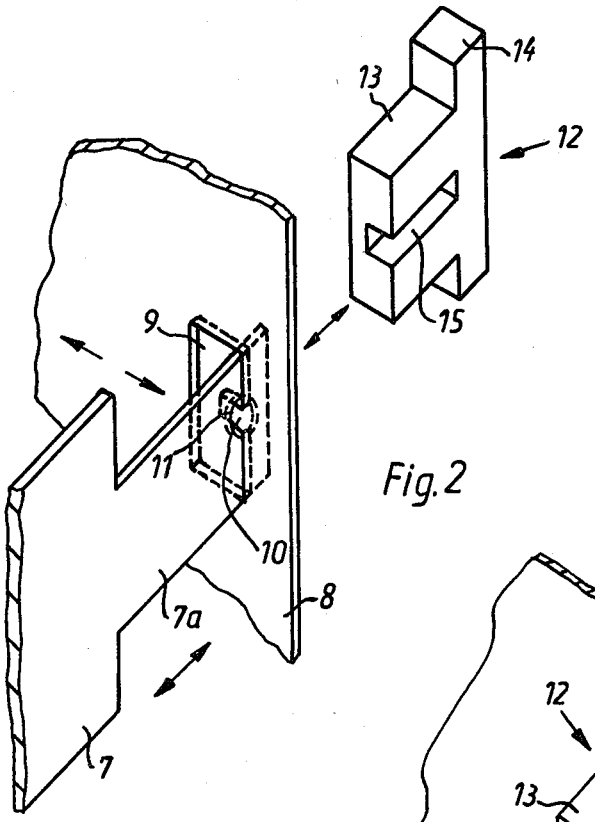

FIG. 2 illustrates in a perspective view a portion of a sidewall 8 which includes a plurality of rectangular cutouts 9 through which the sheets 6, 7 are affixed to the sidewall 8. Guiding sheets 7 (as well as deflecting sheets 6, not illustrated) includes at both ends thereof a locking tongue 7*a* which is adapted to be inserted into cutout 9 on sidewall 8 to effect locking of the sheet to the sidewall. A positioning pin 10 is provided on one of the longer dimensioned sides of cutout 9 and is complementary to and is adapted to cooperate with opening 11 on locking tongue 7*a* of guiding sheet 7.

A locking element 12 formed from a deformable material such as, for example, rubber, is further provided. Locking element 12 includes a parallelepipedal portion 13 and a projecting abutment portion 14. Parallelepipedal portion 13 has approximately the same shape and configuration as cutout 9 in sidewall 8 but the width of parallelepipedal portion 13 is less than that of cutout 9 by an amount approximately equal to the thickness of locking tongue 7*a* of guiding sheet 7. Parallelepipedal portion 13 is further provided with a groove 15 the depth of which is approximately equal to the length of positioning pin 10 less than the thickness of locking tongue 7*a*.

In order to install guiding sheet 7 on sidewall 8, one of the locking tongues 7*a* is first inserted into one of the cutouts 9 of sidewall 8 with the guiding sheet 7 pushed in the direction of the sidewall 8 until the body portion of guiding sheet 7 abuts sidewall 8. Thereupon, locking tongue *7a* at the opposite end of guiding sheet 7 is inserted in the corresponding cutout 9 on the opposite sidewall 8 of the photographic developing apparatus. The lengths of the respective locking tongues *7a* are such that a portion of a locking tongue *7a* which projects beyond the associated sidewall 8 when the body portion of the guiding sheet 7 abuts the opposite sidewall 8. Upon insertion of the two locking tongues *7a* of guiding sheet 7 into their respective cutouts, the openings 11 in both locking tongues are drawn over the positioning pins 10 in each cutout thus securing the guiding sheet against movement in all directions except an unlocking direction, i.e., a direction away from the positioning pins 10 or, in other words, the direction in which the guiding sheet 7 must be moved in order to remove same from the positioning pin 10.

Figure 3:
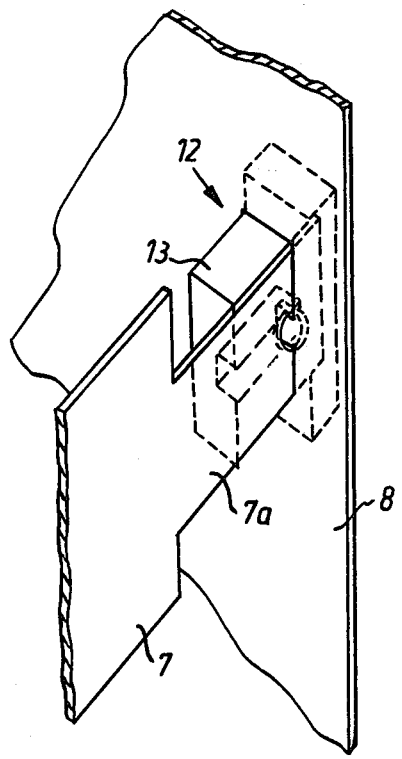
FIG. 3 illustrates the guiding sheet of FIG. 2 in a locked condition.

Upon securing openings 11 to positioning pins 10, the locking element 12 is then installed as illustrated in FIG. 3. Due to the elasticity and deformability of locking element 12, the element presses the locking tongue *7a* against the edge of cutout 9 which is provided with positioning pin 10. The elasticity or deformability of element 12 causes compression of the element in the cutout 9 so that locking tongue *7a* is securely held therein. Accordingly, the guiding sheet 7 is prevented from moving in the unlocking direction.

It will of course be appreciated that deflecting sheets 6 may be configured similarly to guiding sheets 7 and may be similarly secured between the two sidewalls 8 in a conveying arrangement in accordance with the subject invention.

It will be further appreciated that manufacturing tolerances for the guiding sheets and sidealls may be compensated for as a result of the ability of the locking element to deform 12 and fit within cutouts of slightly different sizes. The guiding sheets 7 or deflecting sheets 6 are thus capable of being positioned relatively precisely and installation and removal thereof may be performed easily and very rapidly. In order to remove a guiding sheet 7 or a deflecting sheet 6, it is merely necessary to pull out the locking element 12 at either end of a sheet 6, 7 and to reverse the procedure outlined previously for inserting the sheet 6, 7 in the sidewalls 8.

Without further analysis, the foregoing will so fully reveal the gist of the present invention that others can, by applying current knowledge, readily adapt it for various applications without omitting features which, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. Conveying arrangement for photographic material developer apparatus of the type having a vessel including at least two oppositely disposed sidewalls, said arrangement comprising at least one conveying roller, and at least one material guiding sheet positioned between said oppositely disposed sidewalls, and said arrangement further including means on at least one of said sidewalls adapted to releasably secure said sheet to said sidewall, said means comprising at least one fastening element on said sidewall adapted to prevent movement of said sheet in all directions but an unlocking direction, and said fastening element including a cutout in said sidewall, and at least one positioning pin in said cutout adapted to cooperate with an opening in said sheet, said means further including a removable locking element which is adapted to prevent movement of said sheet in an unlocking direction.

2. The arrangement according to claim 1 wherein said sheet includes at least one locking tongue at one end thereof.

3. The arrangement according to claim 2 wherein the height of said locking tongue and of said cutout are approximately equal and said one locking tongue is adapted to be inserted into and extend through said cutout.

4. The arrangement according to claim 3 wherein said sheet comprises a main section having first and second ends and said tongue extends from said first end, said tongue projecting beyond said sidewall by a predetermined distance when said first end abuts against said sidewall, and said predetermined distance being smaller than the distance between said second end and the other of said sidewalls.

5. The arrangement according to claim 1 wherein said locking element is deformable.

6. The arrangement according to claim 1 wherein said locking element includes a groove adapted to engage the positioning pin in said cutout.

* * * * *